US007463556B2

(12) United States Patent
Hocherman

(10) Patent No.: US 7,463,556 B2
(45) Date of Patent: Dec. 9, 2008

(54) ALARM DEVICE

(75) Inventor: Adam B. Hocherman, Ithaca, NY (US)

(73) Assignee: American Innovative, LLC, Boston, MA (US)

( * ) Notice: Subject to any disclaimer, the term of this patent is extended or adjusted under 35 U.S.C. 154(b) by 270 days.

(21) Appl. No.: 10/917,537

(22) Filed: Aug. 12, 2004

(65) Prior Publication Data

US 2005/0058026 A1 Mar. 17, 2005

Related U.S. Application Data

(60) Provisional application No. 60/503,614, filed on Sep. 17, 2003.

(51) Int. Cl.

| | |
|---|---|
| ***G04B 23/02*** | (2006.01) |
| ***G04B 19/24*** | (2006.01) |
| ***G04C 9/00*** | (2006.01) |
| ***G04C 23/00*** | (2006.01) |

(52) U.S. Cl. ..... 368/74; 368/28; 368/109; 368/187

(58) Field of Classification Search ..... 368/72–74, 368/185, 246, 247, 250, 251, 261, 111, 107–109, 368/101, 89, 28, 187, 29; 200/35 R, 36, 200/38 A, 38 FA, 38 FB, 38 D, 38 DA
See application file for complete search history.

(56) References Cited

U.S. PATENT DOCUMENTS

| | | | | | |
|---|---|---|---|---|---|
| 2,311,380 | A | * | 2/1943 | Gottlieb | 455/231 |
| 2,636,339 | A | * | 4/1953 | Holzner | 368/78 |
| 3,353,347 | A | * | 11/1967 | Gates et al. | 368/40 |
| 3,645,087 | A | * | 2/1972 | Rams et al. | 368/40 |
| 3,766,728 | A | * | 10/1973 | Nagy | 368/39 |
| 3,997,742 | A | * | 12/1976 | Marquis | 200/38 FB |
| 4,012,898 | A | * | 3/1977 | Yoshizawa | 368/78 |
| 4,031,642 | A | * | 6/1977 | Aoki et al. | 40/111 |
| 4,193,120 | A | * | 3/1980 | Yello | 700/16 |
| 4,297,546 | A | * | 10/1981 | Koch | 200/38 R |
| 4,301,524 | A | * | 11/1981 | Koepp et al. | 368/261 |
| 4,385,841 | A | * | 5/1983 | Kramer | 368/29 |
| 4,487,512 | A | * | 12/1984 | Price | 368/66 |
| 4,490,711 | A | | 12/1984 | Johnston | |
| 5,400,302 | A | * | 3/1995 | Yamamoto et al. | 368/107 |
| 5,471,006 | A | * | 11/1995 | Schwartz et al. | 84/609 |
| 5,715,214 | A | * | 2/1998 | Svarnias | 368/10 |
| 5,995,455 | A | * | 11/1999 | Kutosky | 368/73 |
| 6,570,822 | B2 | * | 5/2003 | Stekelenburg | 368/107 |
| 6,934,220 | B1 | | 8/2005 | Cruitt et al. | |
| 2004/0151076 | A1 | * | 8/2004 | Fidel | 368/251 |
| 2005/0190654 | A1 | * | 9/2005 | Patel | 368/73 |

* cited by examiner

*Primary Examiner*—Vit W Miska
(74) *Attorney, Agent, or Firm*—Fish & Richardson P.C.

(57) ABSTRACT

A programmable, microprocessor-based alarm clock apparatus provides seven independent alarms each one of which is specifically tied to one of the seven days of the week. Each alarm may be independently set in terms of appointed alarm-sounding time and active state (either on or off).

28 Claims, 6 Drawing Sheets

ALARM DEVICE

This application claims the benefit of priority of U.S. provisional patent application Ser. 60/503,614, filed on Sep. 17, 2003, and incorporated here by reference.

BACKGROUND

This description relates to alarm devices.

Designs for alarm devices (such as alarm clocks) are many and the features and functions of such devices have been combined in numerous fashions. Typical designs utilize a single button to increment the hour setting on the clock and a second single button to increment the minute setting. An 'Alarm Set' button is pressed and held while the increment keys are tapped in order to set the time or alarm. One or two different alarms can be set. Some devices allow a user to turn weekday alarms on and weekend alarms off, or vice-versa. Users may cycle through available alarm setting times one minute at a time—a total of sixty possibilities for each hour. Known personal computer alarm and scheduling software programs provide alarm mechanisms that operate on weekly, monthly or annual cycles and allow reminders to be set, repeated and cancelled. Some known medication-reminding devices allow a user to set one or more daily alarms for purposes of reminding that individual to take his or her medication.

SUMMARY

In general, in one aspect, a method includes enabling a user to store two or more different alarm times for two or more corresponding days that belong to a repeating cycle of n days, each of the alarm times being applicable to as few as one of the days of the n days, and when at least one of the set alarm times is active, triggering an alarm that is responsive to the set alarm time.

Implementations may include one or more of the following features. The n is 7. There is at least one of the stored alarm times for each of the days and all of the stored alarm times are different. The user is enabled to store the alarm times by decrementing a time setting or incrementing a time setting or both. The decrementing or incrementing is enabled to occur in decrements or increments of more than one minute. Whether an alarm time is active for each of the n days is displayed to a user. The user is also enabled to review the alarm times.

In general, in another aspect, an apparatus includes controls to enable a user to set alarm times for two or more corresponding days that belong to a repeating cycle of n days, the controls including a day selector to enable a user to select individual days from among the n days to which alarm times are to correspond, and a time selector to enable a user to set an alarm time for each of the selected days.

Implementations may include one or more of the following features. The day selector comprises a multiple position switch. The time selector enables the user to decrement or increment the alarm time. The time selector operates by rotation in one direction for incrementing the alarm time and in the other direction for decrementing the alarm time. The time selector is rotatable continuously in either direction. The time selector is biased to return to a center position and has a limited range of rotation in each direction. The day selector and the time selector comprise coaxial knobs. The time selector comprises other than a momentary contact switch. There is also a switch that provides both snooze and alarm review functions. The time selector also provides adjustment of a frequency to which a radio is tuned or a volume to which a radio is set, or both.

In general, in another aspect, a method includes enabling a user to set an alarm on a clock radio, the alarm to be triggered at a specific time, and to associate the set alarm with any selected day of the week.

In general, in another aspect, a method includes enabling a user to selectively either interrupt an alarm or terminate the alarm by interacting with a single interface element of an alarm device.

In general, in another aspect, an apparatus includes a device to inform a user of two or more different alarm times set by the user for two or more corresponding days that belong to a repeating cycle of n days, each of the alarm times being applicable to as few as one of the days of the n days.

Implementations may include one or more of the following features. The device comprises a display including alarm indicators each associated with at least one of the n days. The alarm indicators exhibit one style for alarms that are active and another style for alarms that are inactive. The alarm indicators comprise lights.

In general, in another aspect, a programmable clock apparatus comprises: a) a timekeeping mechanism for accurately keeping track of the time of day and day of week; b) a means for storing seven independent and possibly unique daily alarm-sounding times, each of said alarm-sounding times corresponding to one day of the week; and c) a means for triggering an alert when any of said stored daily alarm-sounding times is coincident with the actual time of day and day of week provided by said timekeeping mechanism and infinitely repeatable on a cycle of seven days whereby a user of said apparatus may input a schedule of said daily alarm-sounding times, repeatable on said cycle of seven days, and be conveniently alerted at said times of day on said related days of week each time said cycle repeats.

Among the advantages of the invention are one or more of the following. Individuals who may not wake, or wish to be alerted, at the same time every day but who likely maintain a similar schedule from week to week can use the device to provide alarms for their schedules. The interface allows a user of the device to rapidly input one or more of the alarm time settings in succession and the input of settings may be operated with one hand so as to be easily interacted with while lying down or reclining. The interface limits the available alarm setting possibilities by incrementing the alarm minute setting in a unit greater than one minute but still small enough to allow the user to enter useful alarm-sounding times. In another implementation, the interface does not limit the amount of available alarm settings. This has the advantage of allowing for the most granular alarm setting times in units of whole minutes. Sleepy individuals may silence a sounding alarm with minimal physical effort and mental exertion but in a way that requires enough attention so as not to be activated inadvertently.

The user of the device is reassured that the desired alarm time has, in fact, been input and the user is alerted to what the very next alarm time and day is when said user invokes the easily-accessible alarm review function.

The device is easy to set. The device incorporates the notion of "day of the week". The user interface is designed to handle intuitively the complexity introduced by incorporating a plurality of alarms, whether daily in design or not. The device provides its features in an elegant and inexpensive fashion.

The settings can be decremented in addition to being incremented. The device uses a rotary mechanism for rapid input of data values and so can be set with one hand. Lying in bed is a convenient place from which to be able to set an alarm with one hand. The non-momentary mechanism enables easily moving the device into the modes designated for setting the various alarms. Many people (particularly students on a college class schedule) wake up at different times on different days and may, additionally, choose not to be awakened at all on select, specific days of the week. The user can selectively choose which specific days on which to have an alarm sound. A unique alarm-sounding time can be set for each individual day of the week and the user can independently decide whether or not that alarm will sound. The upcoming alarm setting is instantly reconfirmed when returned to the 'Run' state (general operating mode). The user has one last opportunity to automatically review the setting he or she has input thus inspiring confidence that the device will actually sound at the appointed time. The very next alarm time setting is indicated whenever the device is taken out of any of the 'Alarm Set' modes and placed into the 'Run' mode. In another implementation, the device does not automatically reconfirm the very next upcoming alarm time setting. Instead, this function is invoked at the will of the user using the alarm review function. This has the advantage of streamlining the user experience while still providing this instant reconfirmation functionality, should the user desire it.

The device is a free standing, hardware-based device. The device can be conveniently located in proper proximity to a sleeping individual (such as on a nightstand). The user can easily enter seven uniquely different alarm-sounding times, tied specifically to the seven days of the week, as well as control the on/off state of these unique alarm-sounding times individually. This arrangement is conducive to the daily wake schedule of the audience.

The device streamlines the user interface required to turn each individual alarm on or off while reducing the part-count of and, as a result, the cost of manufacturing the device.

Other advantages and features will become apparent from the following description and from the claims.

DESCRIPTION

DESCRIPTION

Figure 1:
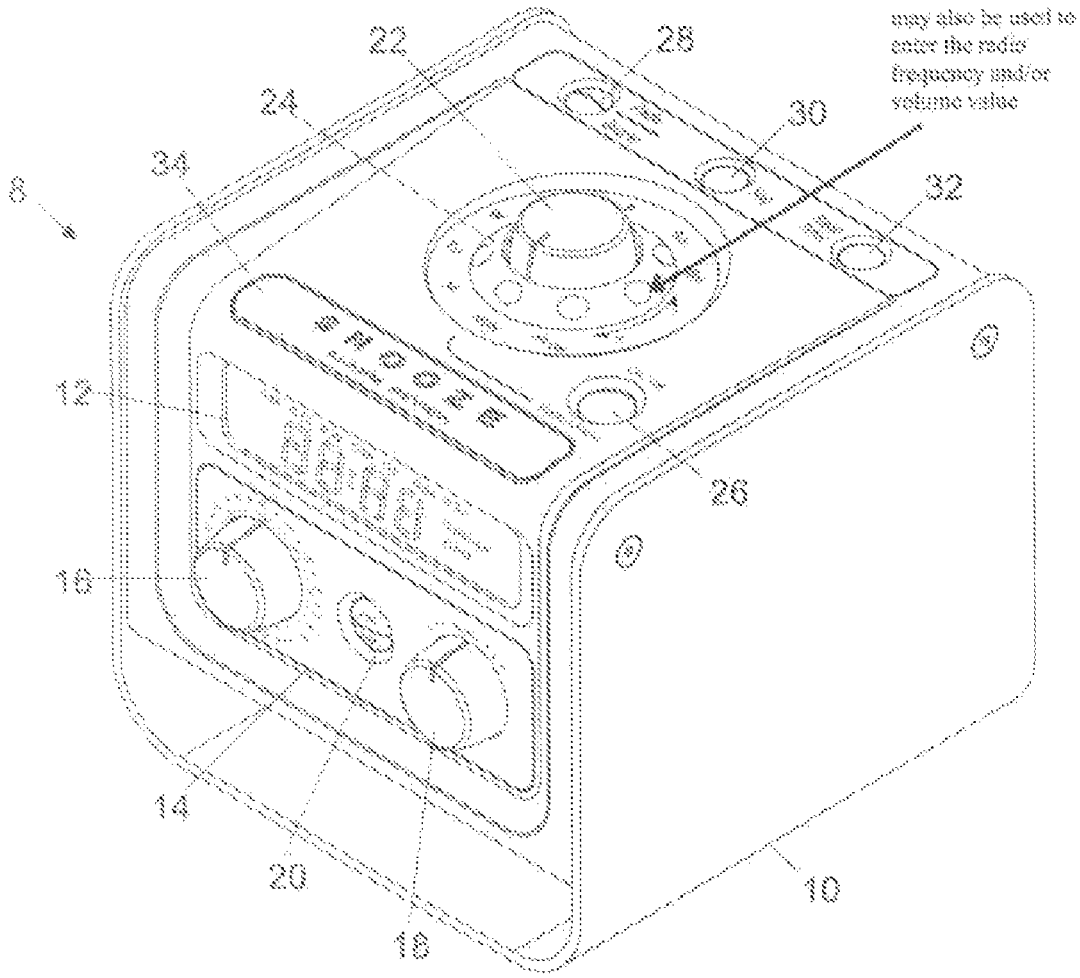
FIG. 1 is an isometric, front three-quarter view of a clock radio.

As shown in the example implementation of FIG. 1, a clock radio 8 (which we sometimes call a "device") has a housing 10 containing a display 12 located on the front side of the device. Also on the front, below the display, are located radio controls 14. The radio controls 14 include a manual, non-digital tuner input 16, a volume input 18 and a band (AM/FM) selector 20.

The top side of the device contains other controls 22-34 necessary to invoke various functions. A mode selector knob 22 is a rotary-style switch and is located top-center. A value input collar 24 (which represents an example of a movable control and of a concentric control) rotates freely and independently either clockwise (for incrementing values) or counterclockwise (for decrementing values) around the mode selector knob 22 and is used to input various parameters, dependent upon the current mode setting, as described below. A 'Radio/Alarm-On/Off' button 26 is a momentary-contact switch located slightly below and to the right of the nested mode selector knob 22 and value entry collar 24. Functionality surrounding this button is described below.

According to at least some embodiments, a 'Radio/Buzzer' selector 28, 'Nap' button 30 and 'Sleep Timer' button 32 are located along the back edge of the top surface of the device. The 'Radio/Buzzer' selector 28 is a toggle-style switch used to select whether alarms will sound to a buzzer or to the radio station currently tuned. The 'Nap' button 30 is a momentary-contact switch and is used to invoke the nap timer function. The 'Sleep Timer' button 32 is a momentary-contact switch and is used to invoke the sleep timer function. A 'Snooze/Alarm Review' button 34 is located on the front edge of the top surface of the device. This button is a momentary-contact switch and is used to invoke both the 'Snooze' and 'Alarm Review' functions. Functionality surrounding the 'Nap', 'Sleep Timer', 'Snooze' and 'Alarm Review' functions is described below.

Figure 2:
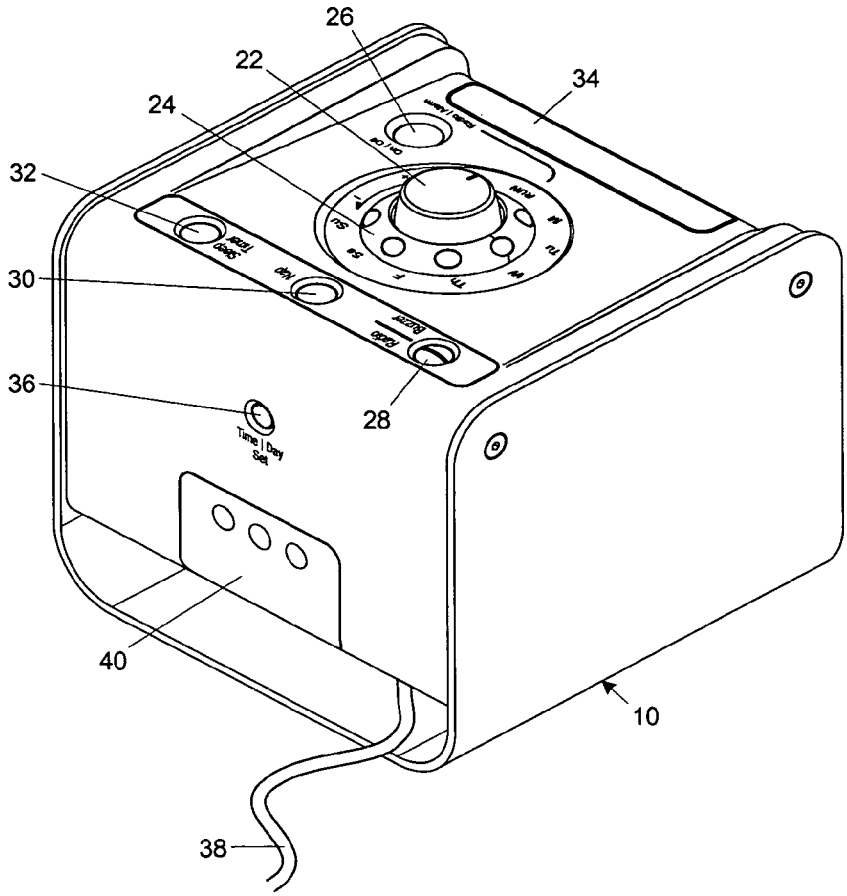
FIG. 2 is an isometric, rear three-quarter view of a clock radio.

As shown in the example implementation of FIG. 2, a 'Time/Day Set' button 36 is a momentary-contact switch located in a slight recess on the back center of the device. This button is used to invoke a 'Time/Day Set' sequence 100 described below. A power cord 38 protrudes from the back of the housing 10 and is used to connect the device to an appropriate external power source. A backup battery cover 40 is also located on the back of the device and conceals an alternate power source used to retain the time and alarm settings in the event of loss of the primary power source.

Figure 3:
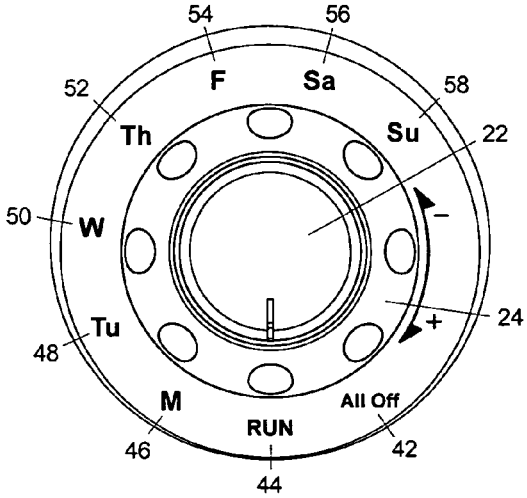
FIG. 3 is a two-dimensional detail view of a mode selector knob and value entry collar.

As shown in FIG. 3, an example of the mode selector knob 22 is a rotary-style switch including nine distinct positions 42-58. The nine positions correspond to the various modes of operation of the device, described in more detail below. The modes are 'All Off' 42, 'Run' 44 and seven 'Alarm Set' modes 46-58 that correspond to the seven days of the week, Monday through Sunday.

Figure 4A:
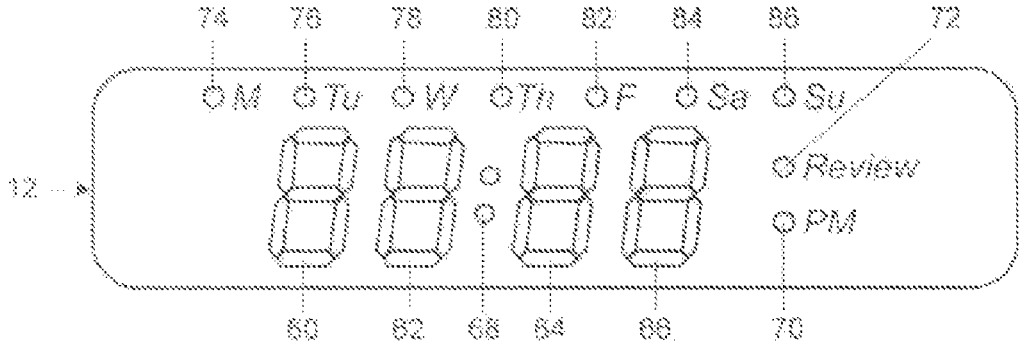
FIG. 4A is a two-dimensional detail view of a display.

As shown in FIG. 4A, an example display 12 includes two main areas of functionality—digital clock display elements 60-70 and daily indicator lamps 74-86. Digital clock display elements 60-70 include four seven-segment digital numerals 60-66 located in a horizontal row, the first two and last two of which are separated by a colon element 68. A 'PM' lamp 70 is located to one side of the seven-segment digital numerals 60-66 and is used to indicate that the hour indicated on the display, in twelve-hour format, is an afternoon hour.

Located above the digital clock display elements 60-70, the daily indicator lamps 74-86 correspond to the seven days of the week, Monday through Sunday. Functionality surrounding these lamps is discussed in detail below.

A 'Review' lamp 72 is also located to one side of the seven-segment digital numerals 60-66 and above the 'PM' lamp 70. The 'Review' lamp illuminates when the 'Alarm Review' sequence 300 has been invoked. The 'Alarm Review' sequence 300 is discussed in more detail below.

Figure 5:
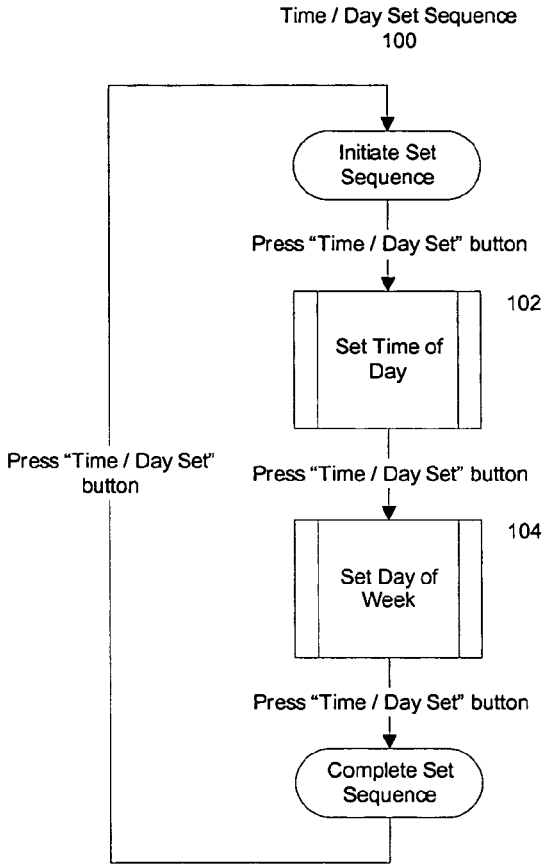
FIG. 5 is a flowchart depicting the 'Time/Day Set' sequence—the steps required to set the time of day and day of week.

FIG. 5 describes an example 'Time/Day Set' sequence 100. This sequence describes the process of inputting the present time of day and day of week into the device. The 'Time/Day Set' sequence 100 needs to be performed the first time the device is powered on, and every time thereafter that the device is unplugged and that the alternate power source fails to retain the stored time and alarm settings.

To initiate the 'Time/Day Set' sequence 100, the 'Time/Day Set' button 36 is pressed once. This sequence may be initiated regardless of what position mode selector knob 22 is set to. The current mode of operation of the device is thus interrupted and the four seven-segment digital numerals 60-66 flash slowly to clearly indicate that the 'Time/Day Set' sequence 100 has been entered. At this point the present time of day setting may be entered as described in FIG. 6.

Figure 6:
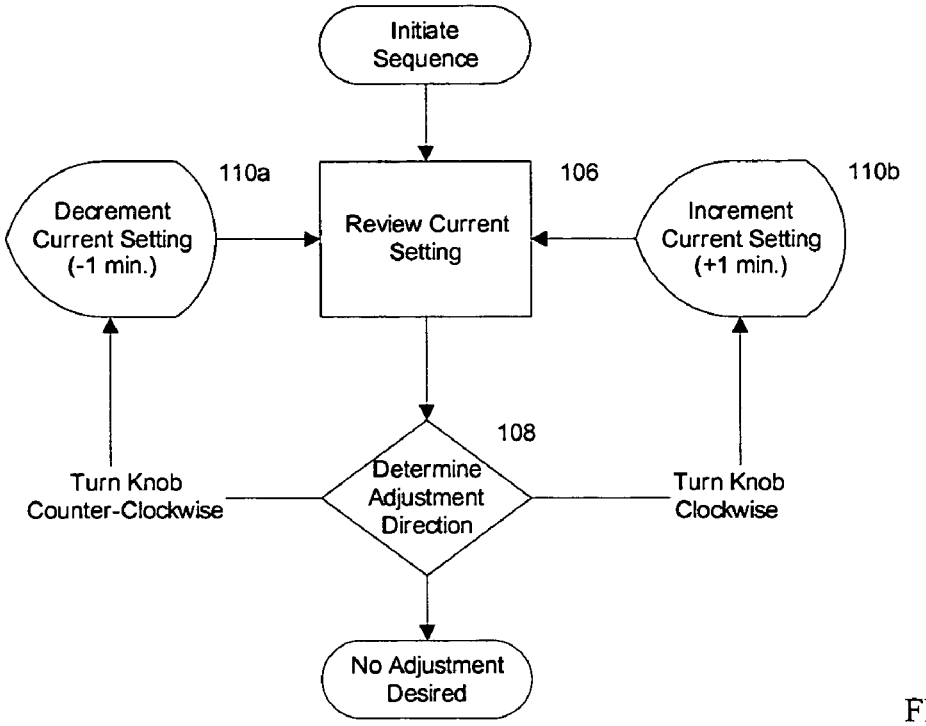
FIG. 6 is a detail-level flowchart depicting the 'Set Time of Day' sub-sequence in greater detail.

As shown in the example of FIG. 6, after reviewing the current setting 106 and determining the adjustment direction 108, a user of the device rotates the value input collar 24 either clockwise or counterclockwise. The digital clock display elements 60-70 change to reflect the new time setting that is incremented 110*b* or decremented 110*a*, respectively, in units of one (1) minute. Once the desired time has been achieved, pressing the 'Time/Day Set' button 36 a second time concludes input of the time and initiates input of the day of the week. The four seven-segment digital numerals 60-66 stop flashing and one of the daily indicator lamps 74-86, the one which indicates the current day setting, begins flashing slowly so as to indicate that a change to the current day setting is pending.

Figure 7:
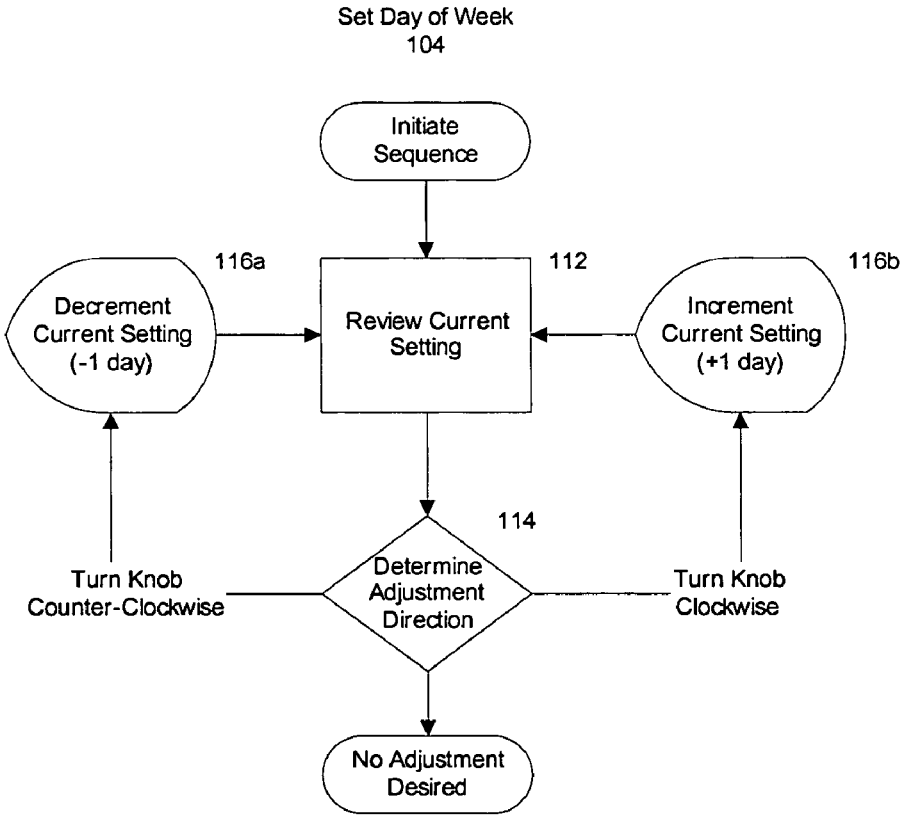
FIG. 7 is a detail-level flowchart depicting the 'Set Day of Week' sub-sequence in greater detail.

In the example shown in FIG. 7, in a 'Set Day of Week' sub-sequence 104, after reviewing the current setting 112 and determining the adjustment direction 114, a user of the device rotates the value input collar 24 either clockwise or counterclockwise. The daily indicator lamps 74-86 light in daily sequence in either increments 116*b* or decrements 116*a*, respectively, of one (1) day. Once the desired day has been achieved, pressing 'Time/Day Set' button 36 a third and final time concludes input of the day of the week. The device returns to the mode for which mode selector knob 22 is currently set and the 'Time/Day Set' sequence 100 is concluded. At any time, a user may reinitiate the 'Time/Day Set' sequence 100 by pressing the 'Time/Day Set' button 36.

Figure 8:
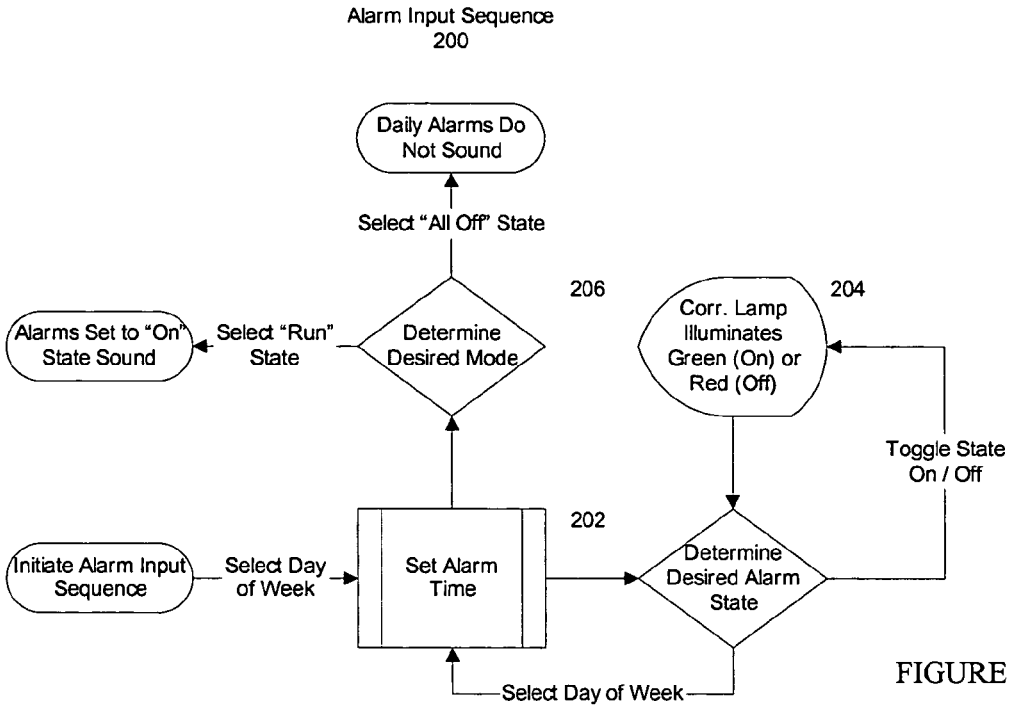
FIG. 8 is a flowchart depicting the 'Alarm Input Sequence'—the steps required to input various alarm settings.

In the example shown in FIG. 8, an 'Alarm Input' sequence 200 describes the process of inputting one or more daily alarm-sounding times and/or active states. An alarm's active state refers to whether that daily alarm is set to sound at its appointed time each week ("on") or whether that day's alarm will be skipped ("off"). The sequence is initiated when mode selector knob 22 is positioned to one of the daily alarm set modes 46-58. The corresponding daily indicator lamp 74-86 illuminates and glows red if that day's alarm is not active or green if that day's alarm is active. Next the user enters the desired alarm-sounding time setting for the selected day.

Figure 9:
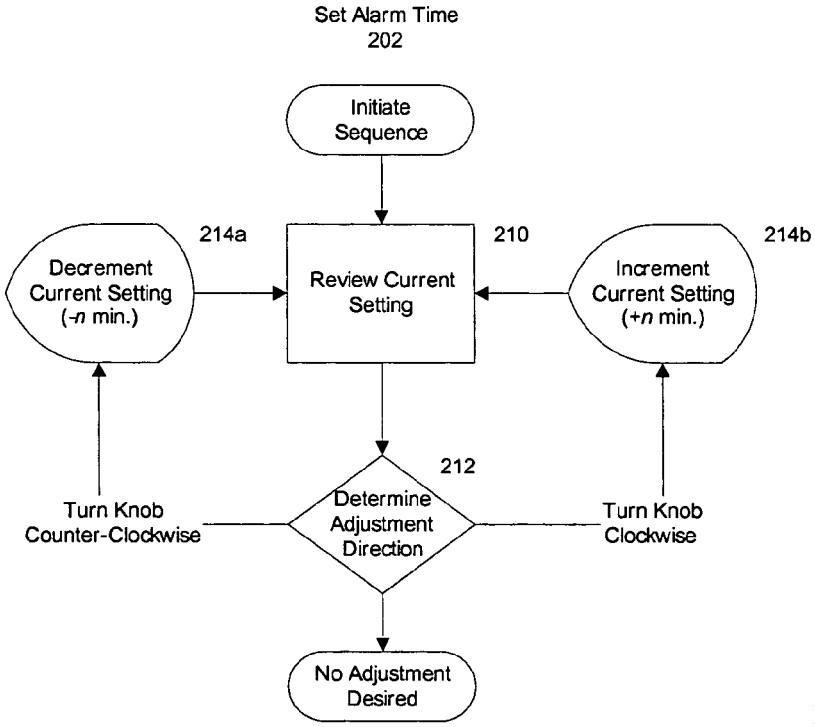
FIG. 9 is a detail-level flowchart depicting the 'Set Alarm Time' sub-sequence in greater detail.

In the example of FIG. 9, during the 'Set Alarm Time' sub-sequence 202, after reviewing the current setting 210 and determining the adjustment direction 212, a user of the device rotates value input collar 24 either clockwise or counterclockwise. The digital clock display elements 60-70 change to reflect the alarm-sounding time setting that is incremented 214*b* or decremented 214*a*, respectively, in units of n minutes where n represents an integer greater than zero but not so large as to forbid a user of the device from entering useful, desired alarm-sounding times. In at least some embodiments, n=5 or n=1.

Regardless of the current active state of the daily alarm being set, that alarm is automatically activated upon input of a change in alarm-sounding time. The daily alarm indicator lamp 74-86 corresponding to said day glows green to indicate that the alarm is active.

At any time during the 'Alarm Input' sequence 200, the active state of the alarm for the selected day may be toggled by pressing the "Radio/Alarm-On/Off" button 26. The corresponding daily indicator lamp 74-86 toggles between a glowing green state (alarm is "on") and a glowing red state (alarm is "off") 204.

If desired, the preceding steps may be rapidly repeated for each day of the week. The sequence is concluded when the user determines the desired mode 206 in which to leave the device. The mode selector knob 22 is returned to either the 'Run' position 44 or the 'All Off' position 42. In 'Run' mode active daily alarm indicator lamps 74-86, only, illuminate on the display 12 and all active daily alarms, only, sound at the appointed time each week. In 'All Off' mode, all daily alarm indicator lamps 74-86 are off and no alarms sound.

Figure 10:
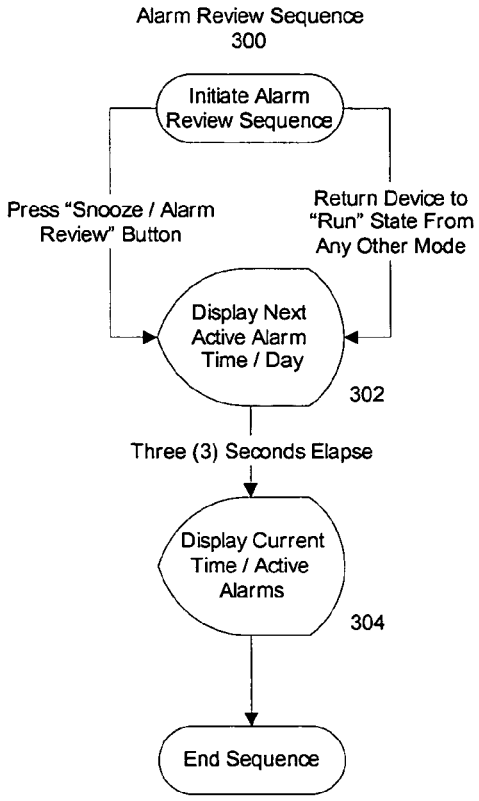
FIG. 10 is a flowchart depicting functionality relating to the 'Alarm Review' function.

In the example shown in FIG. 10, during an 'Alarm Review' sequence 300, the next upcoming alarm-sounding time is relayed to the user for purposes of visual confirmation. The 'Alarm Review' sequence 300 is initiated in one of two ways. Each time the mode selector knob 22 is returned to the 'Run' position 44, display 12 momentarily indicates the next upcoming alarm time of day and day of week 302. After this momentary duration the display returns to the ordinary 'Run' state that indicates the current time and illuminates all daily alarm indicator lamps 74-86 for which associated alarms are active 304. The 'Alarm Review' sequence may also be initiated, manually, at any time when the device is in the 'Run' state and an alarm is currently not sounding, by pressing the 'Snooze/Alarm Review' button 34.

Figure 11:
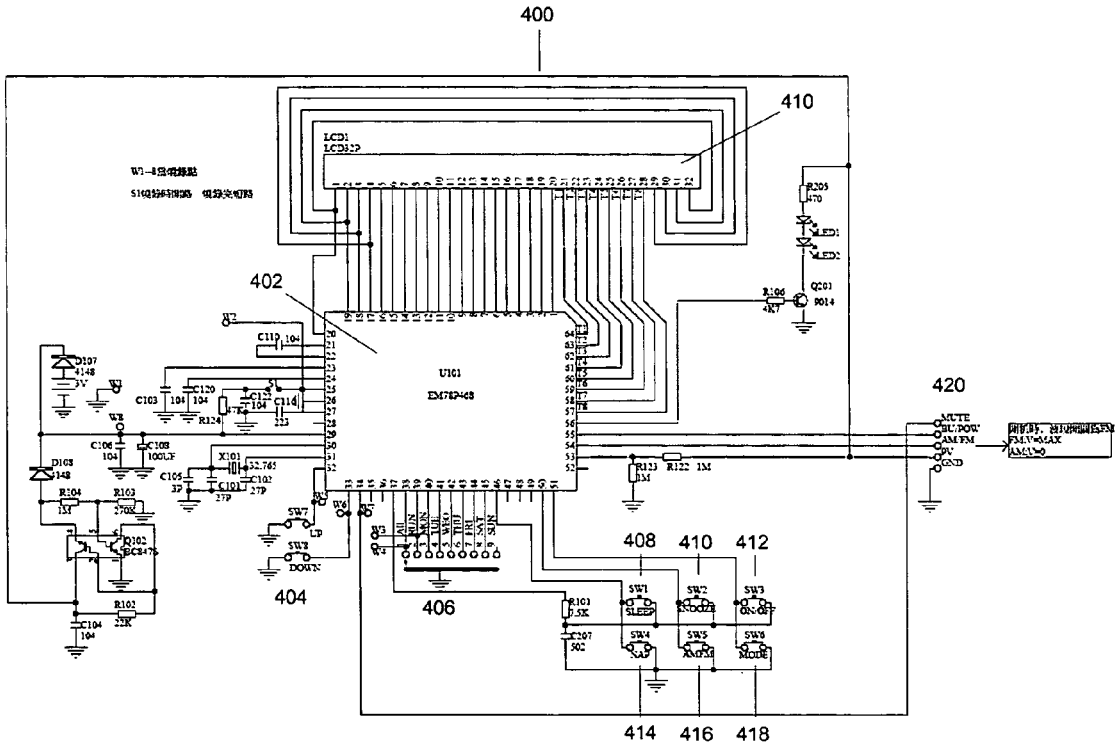
FIG. 11 is a circuit diagram.

In the example circuit 400 shown in FIG. 11, a central Micro-Processing Unit (MPU) 402 controls the operation of the device in response to user inputs provided through rotary collar component 404, mode-dial component 406 and push-button inputs 408-418. Visual feedback is provided via display component 410. An interface 420 provides a connection with conventional AM/FM radio circuitry (not shown).

A sleep timer function is invoked by pressing the 'Sleep Timer' button 32. Pressing this button repeatedly increases the duration of the sleep timer in a preset increment of twenty (20) minutes in at least one embodiment, up to a total of 120 minutes at which point the sleep timer is reset to zero (0) and the cycle repeats. The sleep timer function automatically turns the radio on for the period of time entered, after which time the radio automatically shuts itself off. Pressing the 'Sleep Timer' button 32 at any point during the timed period adds twenty (20) minutes to the timer up to a maximum of 120 minutes. Operation of sleep timer functionality is well known.

A nap timer function is invoked by pressing the 'Nap' button 30. Pressing this button repeatedly increases the duration of the nap timer in a preset increment of twenty (20) minutes in at least one embodiment, up to a total of 120 minutes at which point the nap timer is reset to zero (0) and the cycle repeats. The nap timer function counts down for the period of time entered and then sounds an alarm (either a buzzer or currently tuned radio station depending on the position of the 'Radio/Buzzer' selector 28) at such time that the nap timer reaches zero (0) minutes. Pressing the 'Nap' button 30 at any point during the timed period adds twenty

(20) minutes to the timer up to a maximum of 120 minutes. Operation of nap timer functionality is well known.

In at least some embodiments, the 'Snooze' and 'Alarm Review' functions are activated by a single button, 'Snooze/Alarm Review' 34, so as to streamline the user interface of the device. The 'Snooze' function may be invoked any time when an audible alarm is sounding by tapping the 'Snooze/Alarm Review' button 34. The 'Snooze' function allows a user of the device to temporarily silence a sounding alarm for a preset period of time after which time the alarm becomes audible again. The snooze sequence may be repeated indefinitely.

In 'Run' mode each time a previously set and previously activated daily alarm becomes coincident with that actual time and day of the week, an audible alarm is sounded in the form of either a buzzer or the radio as determined by the current setting of the 'Radio/Buzzer' switch 28. At such time that the alarm is sounding, a user may silence it in one of three ways. A temporary suspension of the audible alarm may be initiated by invoking the 'Snooze' function described above. In at least some implementations, to permanently silence the audible alarm until such time that the next daily alarm is sounded a user may either (a) press the 'Radio/Alarm-On/Off' button 26 once or (b) press and hold the 'Snooze/Alarm Review' button 34 for a duration of three (3) seconds. The latter method of invocation is convenient for sleepy individuals who would prefer not to grope for the smaller 'Radio/Alarm-On/Off' button 26.

In addition to the specialty alarm clock functionality, the device may be operated as an ordinary AM/FM table radio by using the radio controls 14. The radio controls 14 become active when the 'Radio/Alarm-On/Off' button 26 is pressed when the device is in either 'Run' mode 44 or 'All Off' mode 42. At such time, the currently tuned radio station becomes audible. Said radio station may be altered by using the tuner input 16 to change the frequency or by using the band (AM/FM) selector 20 to toggle the band. In addition the volume of the radio may be incremented or decremented by using the volume input 18. The radio may be silenced at any time that it is audible by pressing the 'Radio/Alarm-On/Off' button 26.

Other embodiments are within the scope of the claims.

For example, the radio controls 14 may be removed so that a non-radio version of the device may be provided.

The radio controls 14, which in the examples described above are analog, may be swapped with a digital arrangement and the display 12 may be dual-purposed to display the radio frequency while in a 'Radio' mode. In addition, the value input collar 24 may also be used to enter values pertaining to use of the radio functions, namely the radio frequency and/or volume value.

The mode selector knob 22 may be embodied in an alternate fashion such as a slide-type switch or a series of mutually exclusive pushbuttons, rather than as a rotary control. Alternatively, this switch may be embodied as a combination of a single momentary-contact switch and a series of labeled LED lamps or displayed alpha-numeric messages either of which cycle through indications of the mode as the momentary-contact switch is repeatedly pressed.

The value input collar 24 may be embodied in an alternate fashion such as a pair of momentary-contact buttons, increment and decrement respectively, which may either be tapped or held in order to input values into the device. Alternatively the freely rotating collar arrangement described in the embodiment above may be replaced with a collar of restricted rotation, say 30 degrees off center in either direction, that is center sprung and is momentarily pushed and/or held either clockwise or counterclockwise in order to input values into the device. As another alternative a simple, free-standing rotary knob may be used for this function and the idea of a nested, collar arrangement forgone while still retaining the benefit of a rotary-style input.

The single 'Radio/Alarm-On/Off' button 26 described may be substituted by a series of seven (7) such buttons or toggle switches, each one of which is designated for an individual day of the week, Monday through Sunday.

The bi-color daily indicator lamps 74-86 may be substituted for with single-color lamps which, in the appropriate mode(s), indicate two states by either illuminating (active state is "on") or not (active state is "off").

The 'Run' state may illuminate one of the daily alarm indicator lamps 74-86, the lamp that corresponds to the current day of the week, rather than illuminate all of the daily alarm indicator lamps 74-86 for which associated alarms are active. If that is the case the 'Alarm Review' sequence 300 may illuminate all daily alarm indicator lamps 74-86 for which associated alarms are active in addition to displaying the next upcoming alarm time of day and day of week. The daily alarm indicator lamp 74-86 for which the next upcoming alarm day of week corresponds may be differentiated from the other illuminated (and thus active) alarms by either illuminating in a different color or, alternatively, by flashing slowly.

Figure 4B:
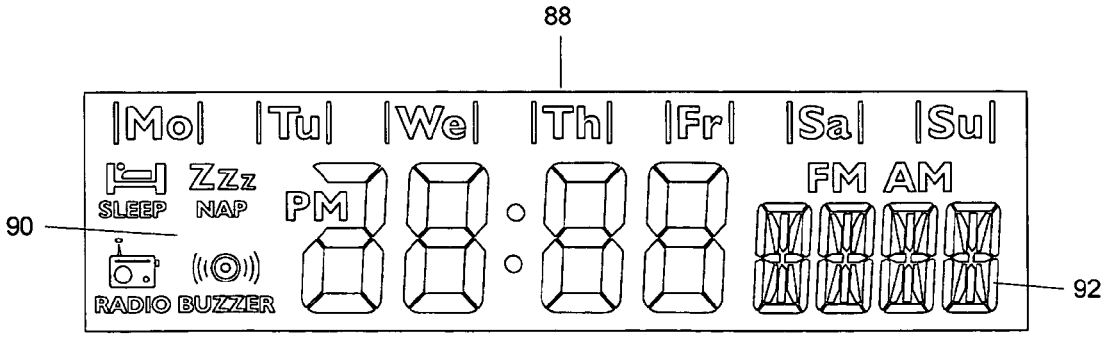
FIG. 4B is a two-dimensional detail view of an alternate, LCD-style display.

As shown in the example in FIG. 4B, a backlit, LCD-style display 88 may be substituted for the LED-style display 12. The LCD display 88 allows for the addition of informational icons 90 and/or other alpha-numeric display additions 92 that may facilitate interaction with the device.

Some implementations could simplify the 'Sleep Timer' and/or 'Nap' functions to have fewer, or even just one, programmable duration.

Some implementations could modify the 'Sleep Timer' and/or 'Nap' functions to use the value input collar 24 to enter values for these functions. In such an embodiment, a consecutive range of values may be input rather than be restricted to the discrete options described in the preferred embodiment.

Some implementations may extend the concept of the 'Time/Day Set Sequence' 100 to be a more general 'Setup' procedure. In addition to providing a mechanism by which the time of day and day of week may be input, any number of additional parameters may be input during this same sequence. These additional parameters may include, but may not be limited to (a) providing a user of the device with the ability to select a preferred wake mode (thus eliminating the need for a uniquely-purposed switch) or (b) providing a user of the device with the ability to input a preferred sleep and/or nap timer duration or (c) providing a user of the device the ability to input a preferred duration for the snooze function. As part of implementing the setup function, the radio/buzzer key may be replaced by a setup key. The choice of buzzer or radio is then selected once during the setup procedure. All alarms and nap timer sound to the selected choice. The setup sequence may have four steps: 1) Set Time (HH:MM), 2) Set Day (Mo-Su), 3) Set Snooze Time (0 min.<Snooze<=30 min.), and 4) Set Wake Mode (Radio or Buzzer).

Some implementations may include a provision for more than one, e.g., m alarms per day all of which sound on a 7-day cycle and which may be made active or inactive, either independently or as a daily group, at the option of the user.

Some implementations may utilize fewer than seven alarms but still have those alarms operate on a 7-day cycle. For example, another arrangement may consolidate the weekend days—Saturday and Sunday—into one single alarm (a total of six) or not have weekend alarms at all for a total of five.

Some implementations may extend the concept of the device to encompass a number of days l, either greater or less than seven. For example, one might envision a device which has fourteen individual alarms and which repeats on a fourteen-day cycle. This arrangement may be useful for linking alarm-sounding times to specific days in, say, a two-week pay period cycle. l may, in fact, equal any value greater than one (1) for which the situation calls.

The device may be combined with other functions such as novelty alarm tones, media-playing functions or atomic clock synchronization. The device may be used in other contexts and by various audiences and still achieve the same objects.

One or more alternate embodiments may omit one or more of the features described above.

What is claimed is:

1. A method comprising enabling a user to select an item for which a time value is to be stored, the item being selected by using a first movable control having physical positions, enabling the user to store a time value comprising at least a minutes value for the selected item by using a second movable control concentric with the first movable control, the second movable control being active when the first movable control is in at least a first one of the physical positions, the second movable control being inactive when the first movable control is in another one of the physical positions, and when the selected time value is met, triggering an alarm.

2. The method of claim 1 in which the item comprises one day of seven different days of the week.

3. The method of claim 2 in which there is at least one of the time values for each of the days and all of the time values are different.

4. The method of claim 1 in which the user is enabled to store the time value by decrementing a time setting or incrementing a time setting or both.

5. The method of claim 4 in which the decrementing or incrementing is enabled to occur in decrements or increments of more than one minute.

6. The method of claim 2 also including displaying to a user, for each of the days, whether a time value is active.

7. The method of claim 1 also enabling the user to review the time values.

8. The method of claim 1 in which the first movable control for the item and the second movable control for the time value comprise different controls.

9. The method of claim 1 in which there are at least two different items for which minutes values can be stored.

10. The method of claim 2 in which there is at least one of the time values for each of the days and the time values are the same for at least two of the days.

11. An apparatus comprising two coaxial controls at least one of which is rotatable, a first one of the controls comprising a first movable control having at least two different selectable physical positions, at least one of the positions corresponding to an item for which a time value is to be stored, a second one of the controls comprising a time selector knob that is concentric with the first movable control and enables the user to store a time value comprising at least a minutes value for the item, the second movable control being active when the first movable control is in at least a first one of the physical positions, the second movable control being inactive when the first movable control is in another one of the physical positions, and a display to indicate the time value including the minutes value.

12. The apparatus of claim 11 in which the first one of the controls comprises a multiple position switch.

13. The apparatus of claim 11 in which the second one of the controls enables the user to decrement or increment the time value.

14. The apparatus of claim 11 in which the second one of the controls operates by rotation in one direction for incrementing the time value and in the other direction for decrementing the time value.

15. The apparatus of claim 14 in which the second one of the controls is rotatable continuously in either direction.

16. The apparatus of claim 14 in which the second one of the controls is biased to return to a center position and has a limited range of rotation in each direction.

17. The apparatus of claim 11 in which the first one of the controls comprises a day selector knob and the second one of the controls comprises a time selector knob.

18. The apparatus of claim 11 in which the second one of the controls comprises other than a momentary contact switch.

19. The apparatus of claim 11 also including a switch that provides both snooze and time value review functions.

20. The apparatus of claim 11 in which the second one of the controls also provides adjustment of a frequency to which a radio is tuned or a volume to which a radio is set, or both.

21. The apparatus of claim 11 in which the device comprises a display including an alarm indicator associated with the item.

22. The apparatus of claim 21 in which the alarm indicators exhibit one style for alarms that are active and another style for alarms that are inactive.

23. The apparatus of claim 21 in which the alarm indicators comprise lights.

24. The apparatus of claim 11 in which at least one of the controls is rotatable.

25. The apparatus of claim 11 in which the item comprises a day belonging to a repeating cycle of n days and a different time value can be stored for each of the days.

26. The apparatus of claim 11 in which the time value comprises a time of a day.

27. A method comprising selecting a day for which a wakeup alarm time is to be stored by rotating a first knob to a position associated with that day, storing the alarm wakeup time by rotating a second knob that is coaxial with the first knob until a display indicates the wakeup time, and repeating the selecting and storing for any number of the days of a week and for any wakeup alarm time on any of the days.

28. The method of claim 27 also comprising enabling a user to selectively either interrupt for a period but not terminate an alarm triggered at an alarm time or completely terminate the alarm by activating a single interface element of an alarm device either for a shorter time or a longer time.

* * * * *